US008393251B2

(12) United States Patent
Dagenais et al.

(10) Patent No.: US 8,393,251 B2
(45) **Date of Patent: *Mar. 12, 2013**

(54) JAW ASSEMBLY FOR GRIPPING PIPES

(75) Inventors: Dan Dagenais, Edmonton (CA); Jonanthan Brent Fraser, Ononway (CA); Leslie L. Szalacsi, St. Albert (CA); Hermann Basler, Stony Plain (CA)

(73) Assignee: McCoy Corporation, Edmonton (CA)

( * ) Notice: Subject to any disclaimer, the term of this patent is extended or adjusted under 35 U.S.C. 154(b) by 2152 days.

This patent is subject to a terminal disclaimer.

(21) Appl. No.: 10/512,970

(22) PCT Filed: May 1, 2003

(86) PCT No.: PCT/CA03/00615

§ 371 (c)(1),
(2), (4) Date: Feb. 13, 2006

(87) PCT Pub. No.: WO03/093632

PCT Pub. Date: Nov. 13, 2003

(65) Prior Publication Data

US 2012/0137834 A1 Jun. 7, 2012

Related U.S. Application Data

(63) Continuation-in-part of application No. 10/135,384, filed on May 1, 2002, now Pat. No. 6,637,296.

(51) Int. Cl.
*B25B 13/50* (2006.01)
*B25B 13/58* (2006.01)

(52) U.S. Cl. ..... 81/57.33; 81/185.1; 81/57.15

(58) Field of Classification Search ..... 81/57.15–57.21, 81/185.1, 186, 57.33
See application file for complete search history.

(56) References Cited

U.S. PATENT DOCUMENTS

| | | | | |
|---|---|---|---|---|
| 2,962,919 | A | 12/1960 | Grundmann et al. | |
| 4,576,067 | A | 3/1986 | Buck | |
| 5,221,099 | A | 6/1993 | Jansch | |
| 5,451,084 | A | 9/1995 | Jansch | |
| 5,911,796 | A | 6/1999 | Buck | |
| 6,253,643 | B1 | 7/2001 | Buck | |
| 6,378,399 | B1 | 4/2002 | Baugert | |
| 6,637,296 | B1 * | 10/2003 | Fraser et al. | 81/57.15 |

* cited by examiner

*Primary Examiner* — David B Thomas
(74) *Attorney, Agent, or Firm* — Field LLP

(57) ABSTRACT

A jaw assembly for a power tong or back-up tong is provided with a jaw die plate and a die seating surface that are shaped to permit radial insertion of the die plate (7) onto its seating surface (2). Both vertical (4) and horizontally (6) aligned splines, or spline segments are present on the seating surface. The vertical splines are interrupted along on at the end of their lengths by gaps (5*a*). Grooves (11) along with the protrusions (10) on the mating surface of the die plate interfit between the splines and/or spline segments and gaps to stabilize, or anchor the die plate on the seating surface against vertical displacement and to absorb rotational torque forces. The portion of the protrusions on the die plate that are positioned to extend into the gaps in the vertical splines support the die plate against vertical shearing forces, resisting disengagement of the die plate from its seating surface.

9 Claims, 4 Drawing Sheets

JAW ASSEMBLY FOR GRIPPING PIPES

This application is entitled to the benefit of and is a Continuation-in-Part of prior U.S. application Ser. No. 10/135,384 filed on May 1, 2002 now issued as U.S. Pat. No. 6,637,296 on Oct. 28, 2003, pursuant to 35 USC 365(c) and 35 USC 120.

FIELD OF THE INVENTION

This invention relates to an apparatus for gripping tubular members and, in particular, pipes in the oil well industry. More specifically, it relates to an interchangeable faceplate to be placed on a jaw carrier whereby the faceplate serves to engage reliably with pipe.

BACKGROUND TO THE INVENTION

In the oil and gas industry, in order to grip drill pipe it is necessary to apply high gripping forces while simultaneously rotating the pipe or restraining the pipe against rotation. Typically, such forces are now applied to pipe through the use of power tongs or a back-up tong. Within a power tong, a jaw assembly is rotatably mounted with provision for jaw surfaces within the assembly to receive and embrace the pipe once torque is to be applied. A back-up tong has similar jaw surfaces.

It is normal to use gripping plates which are inserted into the jaw assembly as the actual component that contacts with the pipe. These jaw plates or die inserts are typically made of hardened metal, and/or carry a gripping, eg. textured, surface which is suited for developing a high; frictional contact with the surface of pipe. They may also have smooth surfaces formed on softer metal. Such die inserts are installed within a jaw assembly at the focal point for the forces which are to be applied to pipe. Those forces include a rotational torque intended to turn the pipe in order to make or break pipe joints or carry-out rotation for drilling; a compressional force caused by the camming surface of the rotary gear forcing the jaw assembly to press up against the pipe, and vertical forces arising, as for example, when the weight of a power tong rests upon, or is dropped onto, the pipe.

As such jaw plates are subject to wear, they must be readily replaceable within the jaw assembly. Various systems for attaching jaw plates within a jaw assembly have been proposed. In particular, U.S. Pat. Nos. 4,576,067; 5,911,796 and 6,253,643 all to Buck describe a removable die plate which is provided with an external, convex surface having splines which run vertically. These splines mate with complementary grooves formed in the body of the jaw assembly. The splines serve to provide the necessary torque transfer between the jaw assembly and the jaw plates, serving to hold the die plate in place while rotating forces are applied to the pipe.

In U.S. Pat. No. 4,576,067 the jaw plate or die is held vertically in place by conventional means such as a screw that engages with a lip protruding from the convex surface of the die plate. While the splines of this prior invention provides a much greater and more robust surface area between the jaw assembly and the die plate to transfer rotational forces, the screw and lip arrangement makes little provision to absorb vertical forces that may arise when a section of pipe is lowered or raised vertically, carrying the power tong with it. The vertical forces arising under oil field conditions may be substantial. In the referenced U.S. patent above the only provision to accommodate such forces is the screw and lip feature as described. Depending on the dimensions of these components the lip and screw feature may be inadequate to support substantial vertical loads.

In U.S. Pat. No. 6,253,643 upper and lower lips or ledges are provided to contain the jaw plate. These lips are removeably attached to the jaw assembly by fasteners. To more securely absorb vertical loads arising between the jaw plate and jaw assembly, a curved insert is fitted into a keyway provided by opposed annular slots formed in the jaw plate and jaw assembly splined surfaces. Thus installation of this jaw plate also requires manipulation of an insert.

In the case of prior art designs the splines are cut with gear-like orientations. Consequently, the jaw plate must normally be slid into place. The die plate in these disclosures may not readily fit directly in place by a face-on-face insertion procedure due to the angles of the outer splines and grooves along the die plate edges.

It is an object of this invention to provide an improved form of jaw plate or die that is adapted to better transfer vertical forces between the jaw plate and the jaw assembly to which it is mounted and is more easily fitted into place. It is a further object of this invention to provide improved means for restraining a jaw plate against vertically-applied forces.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims, which conclude this Specification.

SUMMARY OF THE INVENTION

According to the invention in one aspect, a jaw assembly for gripping tubular members is provided which includes a concave seating surface within a jaw plate carrier portion of the jaw assembly, such concave seating surface having a plurality of parallel, axially aligned, vertical grooves arcuately spaced on said concave surface and interspersed by vertical splines. At least some of the splines are interrupted or bounded by gaps, forming vertical spline segments. Gaps are preferably provided by at least one, and preferably a plurality of parallel, horizontal grooves spanning said concave surface, preferably substantially from side to side. When two or more horizontal grooves are present, the horizontal grooves define one or more curved horizontal splines or horizontal spline segments. Horizontal spline segments may arise from, horizontal splines that are interrupted by optional spaces as further described below. Portions of the horizontal grooves qualify as gaps which arise between horizontal splines, in line with vertical splines. In a sense, in-line portions of the horizontal splines serve as extensions of the vertical spline segments. Splines and spline segments qualify as spline means.

This concave seating surface mates with a jaw plate or die having a convex surface with a complementary array of protrusions, preferably vertically and horizontally aligned that are positioned and dimensioned to engage with at least portions of the vertical grooves and at least portions of the gaps, present in the jaw plate carrier portion. Slots are present between such protrusions to intimately receive the splines and/or spline segments on the jaw plate carrier portion of the jaw assembly to thereby ensure the effective transfer of forces between the die and the seating surface. The penetration of die plate protrusions into gaps in the vertical splines on the seating surface anchors the die plate against vertical displacement of the die plate with respect to the seating surface on the jaw assembly.

The pattern or layout of the vertical and horizontal grooves and/or gaps and corresponding protrusions, is flexible. The horizontal groove or grooves may be bounded by by the vertical grooves, above and/or below the horizontal groove or grooves. Or the vertical grooves may be bounded by the horizontal groove or grooves, eg. above and/or below the vertical grooves. And these respective grooves and/or gaps may be interspersed arranged on the seating surface in any manner that provides satisfactory coupling between the jaw plate and the jaw plate carrier portion of the jaw assembly.

According to another aspect of the invention, the fit between the jaw plate and jaw plate carrier portion allows the jaw plate to be radially pressed into position by radial advancement of the jaw plate into the concave seating surface.

By a further aspect of the invention the horizontal splines on the seating surface may be interrupted by spaces that are aligned with the vertical grooves so as to allow a vertical sliding insertion of a die plate having strictly vertically aligned protrusions (splines) and slot (grooves) on its convex surface. Such spaces on the seating surface convert the horizontal splines into horizontal spline segments.

The appearance created by this last configuration is that of a waffle pattern with the spaces within horizontal spline segments that are in line with the vertical grooves. In such case, a radially-insertable jaw plate according to the invention may still be anchored in place by mating with the jaw carrier seating surface with portions of the protrusions of the jaw plate extending into at least the gaps, and further portions extending into the horizontal groove or grooves of the seating surface, at locations other than the spaces, in vertical alignment with the spline segments present on such seating surface.

As indicated above, the penetration of die plate protrusions into gaps in the vertical splines on the seating surface anchors the die plate against vertical displacement of the die plate with respect to the seating surface on the jaw assembly. However, with spaces present in the horizontal splines, the vertical grooves on the seating surface may extend for the entire vertical span of the seating surface due to the presence of such spaces. An advantage of providing a seating surface of this design is that such a seating surface may receive jaw plates having strictly vertically aligned protrusions (splines) and slots (grooves), as well as jaw plates with dual types of protrusions, according to the invention.

In this manner the objective is achieved of providing an engagement surface between the jaw plate and the jaw carrier assembly that extends the capacity of the interface between these components to transmit not only a rotary torque to a pipe, but also to absorb vertical loads as well.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
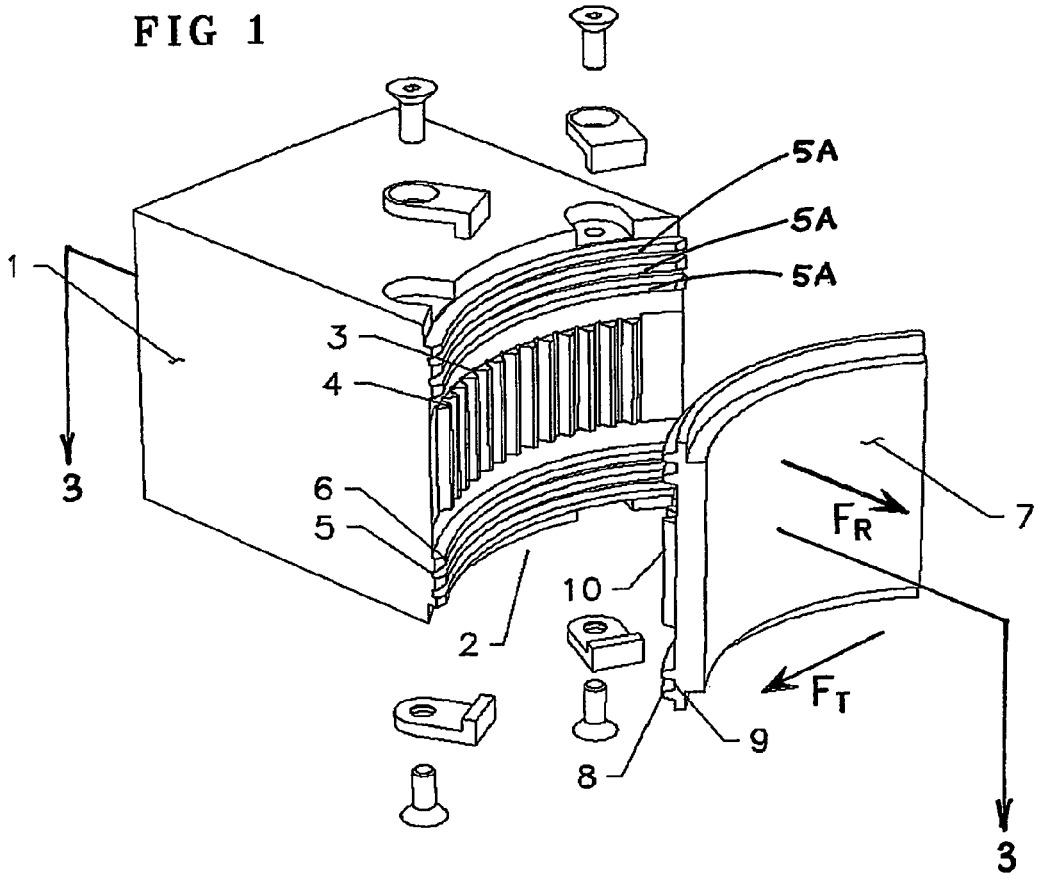
FIG. 1 is a perspective exploded view of a jaw plate carrier portion of a jaw assembly with a jaw plate according to the invention with both vertical and horizontal splines cut into the concave seating surface on the jaw plate carrier portion, aligned for engagement with a complementary pattern of grooves and protrusions formed on the convex surface of the jaw plate at a plate-to-carrier interface.
Figure 3:
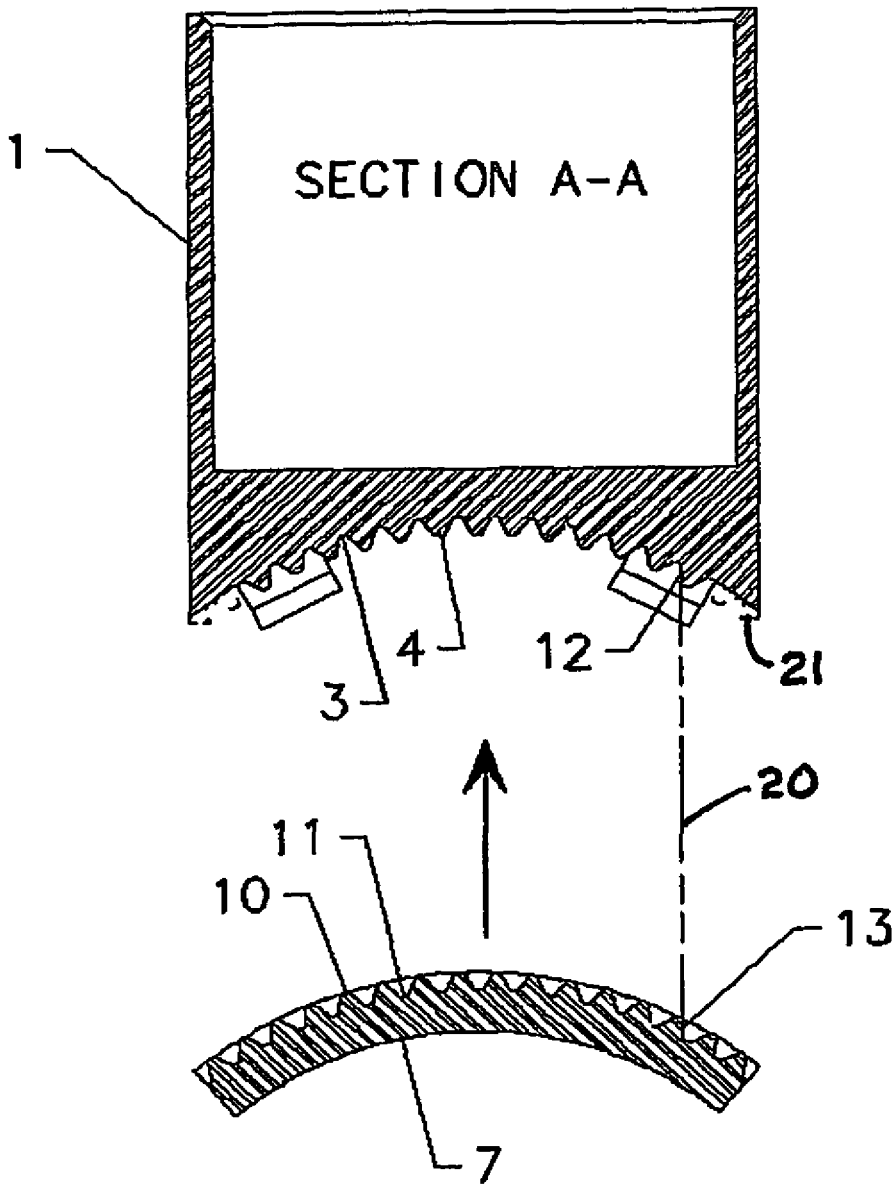
FIG. 3 is a top plan cross-sectional view taken through the central plane of the seating surface on the jaw carrier portion of FIG. 1, through the vertical splines and grooves, aligned to receive a jaw plate of FIG. 2 onto the carrier seating surface by radial advancement.

In FIGS. 1 and 3 a jaw plate carrier portion 1, or "carrier" 1 has a concave die plate engagement or seating surface 2 provided with vertical grooves 3 interspersed between vertical splines 4. This concave surface defines and axis which is vertically oriented in the following description. The seating surface 2 also preferably has horizontal grooves 5 interspersed between horizontal splines 6. The horizontal grooves 5 provide gaps 5A in line with the vertical splines 4. It is these spline gaps 5A that provide the means for stabilizing a die plate against vertical displacement on the carrier seating surface.

Figure 2:
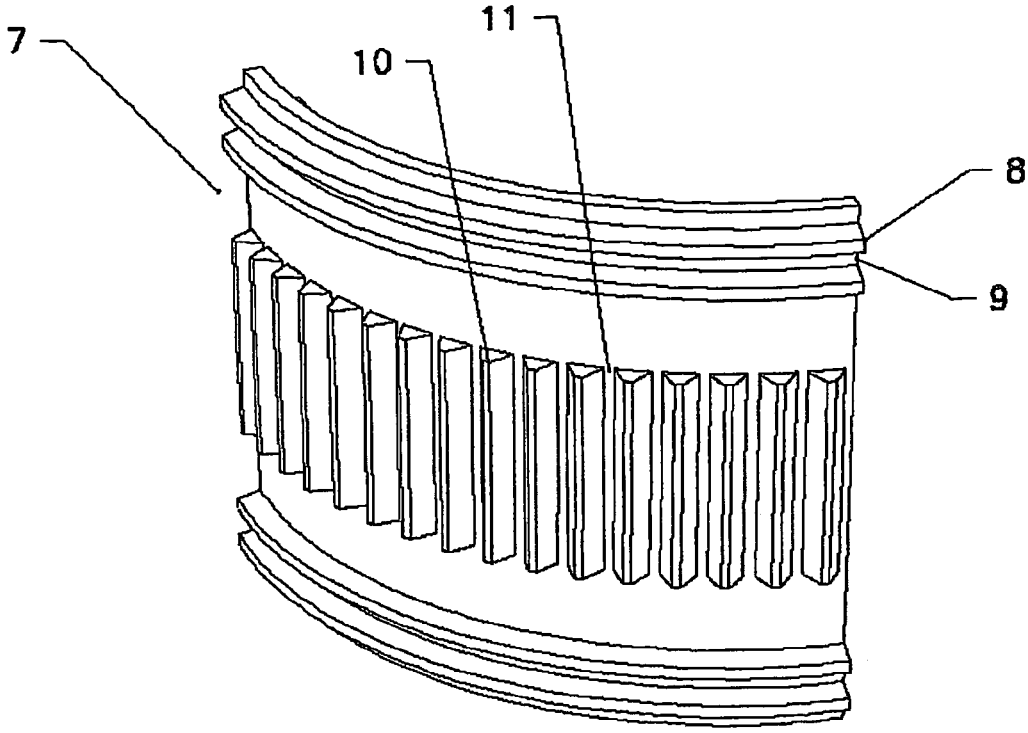
FIG. 2 is a perspective view of the jaw assembly engagement face surface of a jaw plate designed to engage the seating surface on jaw plate carrier portion of FIG. 1.

In FIGS. 2 and 3 a jaw plate 7 has horizontally aligned protrusions 8 shown in FIG. 2 as horizontal die plate splines, with intervening horizontal die plate grooves or slots 9 on its carrier-engaging surface. These horizontal protrusions 8 and slots 9 interfit on assembly with the horizontal grooves 5, gaps 5A and splines 6 on the seating surface. While multiple horizontal slots 9 and protrusions 8 are shown, it is only necessary for there to be protrusion means, eg. a number of protrusions, that interfit into gaps 5A in the vertical splines 4 to stabilize the die plate 7 against vertical displacement. These protrusions serve as anchoring protrusions. Such protrusions may also fully or partially occupy any other portions of any horizontal groove or grooves on the seating surface 2 to further fix the die plate 7 against vertical displacement.

The jaw plate 7 also has a series of vertical protrusions 10 (that are preferably spline-like) with intervening vertical slots 11 on its convex carrier-engaging surface. These vertical protrusions 10 and slots 11 interfit on assembly with the vertical grooves 3 and splines 4 of the seating surface 2 and serve as a torque transmitting protrusions. Through contact between the vertical splines 4 and vertical protrusions 10, torquing forces FT may be transmitted to the die 7 while radial forces FR are applied to a pipe.

It will be seen in FIG. 3 that the vertical splines 4 on the carrier 1 have sides 12 that are aligned to permit entry of the vertical protrusions 10 so that the side surface 13 of the vertical protrusions 10 may at least pass by spline side surface 12, and preferably mate with such side surface 12 when the jaw plate 7 is seated on the carrier 1.

The vertical line 24 shows these faces 12, 13 aligned at their limit to permit engagement when the protrusions are all similar in profile, as when made on a gear-cutting machine. Missing are protrusions at location 25 which would otherwise cause an interference to radial insertion of the jaw plate 7.

Figure 4:
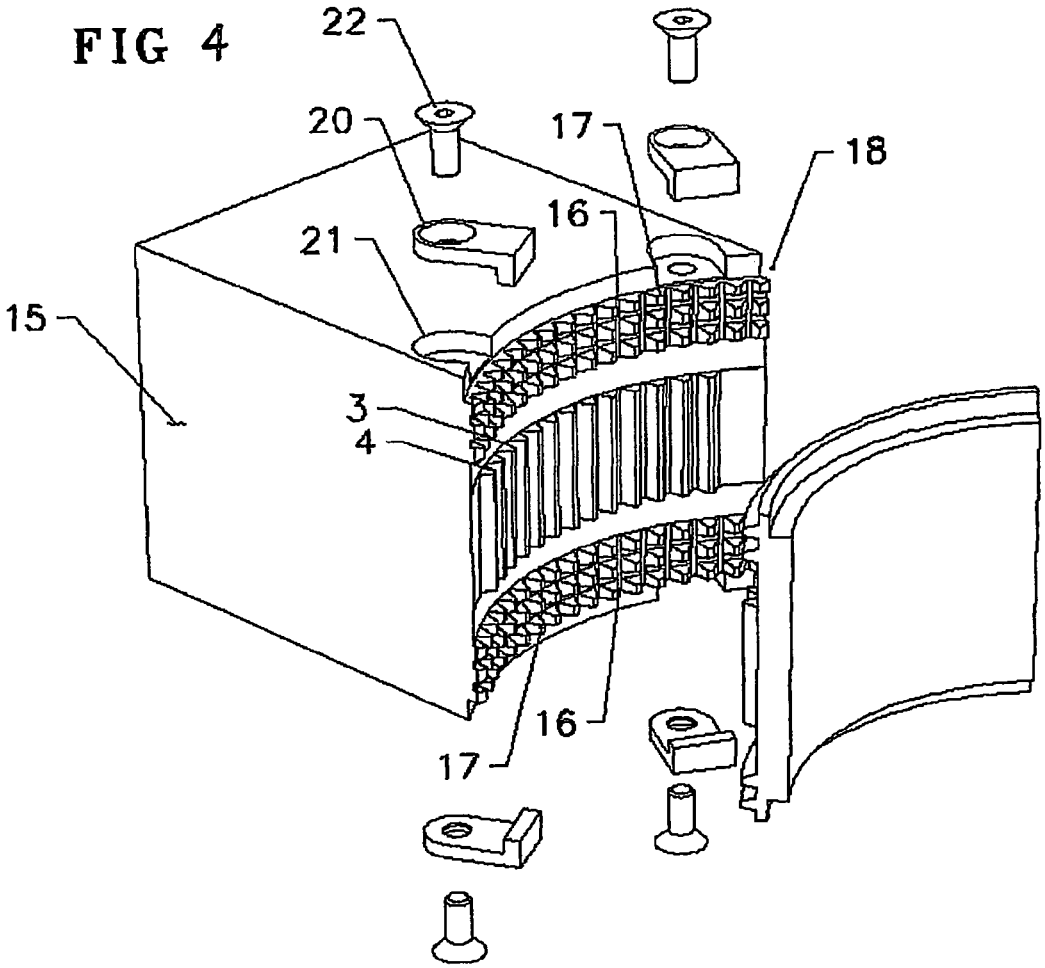
FIG. 4 is a perspective view of the concave seating surface on a jaw plate carrier portion similar to FIG. 1 wherein the horizontal splines formed by horizontal grooves are interrupted by spaces that are aligned vertically with the vertical grooves on the seating surface to form horizontal and vertical spline segments having a waffle pattern appearance.

In FIG. 4 a modified carrier 15 of preferred design has the same set of vertical splines 4. However, the horizontal splines 6 of FIG. 1 are interrupted by spaces 16 to provide a series of vertical spline segments 17 in line with vertical splines 4. The horizontal splines 6 are also now reduced to horizontal spline segments that coincide with the vertical spline segments 17.

While spline segments formed from the horizontal splines 6 are shown in FIG. 4 both above and below the vertical splines 4, such horizontal splines 6, and horizontal segments may be provided on either the top or bottom of the seating surface 2. Alternately, they may occur at other convenient locations across the seating surface 2, so long as the requisite gaps and optional spaces are present.

The jaw plate 7 is unchanged in FIG. 4 and will still mate with the modified seating surface 18 on the modified carrier 15. However the modified seating surface 18 will now receive a jaw plate (not shown) with strictly vertically aligned protrusions and slots. As die plates of this type are already available on the market, this design allows users a choice as to the type of jaw plate they will employ.

In FIG. 4 coupling links 20 are fitted in seats 21, held by fasteners 22, to limit both vertical displacement of the jaw plate 7 and dislodgement of the jaw plate 7 from its seating surface 2, 18 during die installation on the seating surface and prior to engagement of pipe. As vertical forces are principally absorbed across the seating surface 2, 18, the links 20 may be of light weight and serve only for security during fitting of the jaw plate 7 to the carrier 1, 15.

On the basis of the foregoing arrangement, a new and useful configuration for coupling replaceable jaw plates to jaw carrier assemblies has been described.

CONCLUSION

The foregoing has constituted a description of preferred embodiment of the invention and means by which the invention may be put into use. These embodiments are only exemplary. The invention in its broadest, and more specific aspects, is further described and defined in the claims which now follow. These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property or privilege is claimed are defined as follows:

1. A jaw assembly for gripping tubular members comprising a jaw plate carrier portion for receiving a jaw plate having a carrier-engaging surface with protrusions present thereon, said carrier portion having a concave jaw plate seating surface with a vertical axis, such concave seating surface comprising a plurality of axially aligned, generally parallel, vertical grooves arcuately spaced along said concave seating surface, with vertical spline means formed therebetween, and further comprising one or more spline gaps in said vertical splines means for receiving said protrusions on said jaw plate, said seating surface and vertical spline means being dimensioned to receive said jaw plate by radial insertion of the jaw plate onto the seating surface.

2. A jaw assembly as in claim 1 wherein said spline gaps are provided by one or more generally horizontal grooves extending arcuately along said seating surface.

3. A jaw carrier assembly as in claim 2 having two or more horizontal grooves wherein the horizontal grooves define horizontal spline means.

4. A jaw carrier assembly as in claim 3 wherein said horizontal spline means are interrupted by spaces to provide horizontal spline segments said spaces being vertically aligned with said vertical grooves to permit the vertical sliding insertion of a jaw plate having vertically aligned slots and protrusions onto the jaw plate seating surface of the carrier position.

5. A jaw assembly as in claim 1 in combination with a jaw plate having a convex carrier-engaging surface and having protrusions present on said carrier-engaging surface, said protrusions being interspersed by slots, a first portion of said vertical protrusions being positioned and dimensioned to matingly engage with the vertical grooves of the jaw plate carrier portion, and a second portion of said protrusions being positioned and dimensioned to matingly engage with said spline gaps, said slots being positioned and dimensioned to matingly receive said vertical spline means thereby to provide an interface that will effect transfer of both horizontal rotational forces and vertical forces therebetween.

6. A jaw plate for engagement with a jaw plate seating surface on a jaw assembly of a power tong or backup tong, said seating surface having spline means with gaps present and grooves present between said spline means, said jaw plate having a convex surface with a plurality of torque transmitting protrusions interspersed by vertically aligned slots formed thereon for interengagement with said spline means and grooves there being anchoring protrusions aligned with at least two or more of said slots present on said convex surface to interface with said gaps.

7. A jaw plate as in claim 6 wherein said torque transmitting protrusions are in the form of an array of vertically and horizontally aligned protrusions interspersed by said slots.

8. A jaw plate as in claim 6 wherein the torque transmitting protrusions interspersed by vertically aligned slots comprise vertically aligned splines.

9. A jaw plate as in anyone of claim 6 wherein the anchoring protrusions comprise one or more horizontally aligned splines.

* * * * *